United States Patent [19]

Bennett

[11] 4,138,864

[45] Feb. 13, 1979

[54] CABLE STITCH HOLDER FOR KNITTING

[76] Inventor: Dorothy L. Bennett, 555 Eddy St., San Francisco, Calif. 94109

[21] Appl. No.: 805,972

[22] Filed: Jun. 13, 1977

[51] Int. Cl.[2] ..... D04B 3/00

[52] U.S. Cl. ..... 66/1 A; 66/117

[58] Field of Search ..... 66/117, 1 A, 118, 123; 289/17

[56] References Cited

U.S. PATENT DOCUMENTS

| | | | |
|---|---|---|---|
| 2,043,958 | 6/1936 | Engel | 66/117 |
| 2,248,341 | 7/1941 | Crumb | 66/117 |
| 2,274,572 | 2/1942 | Yates | 66/117 |
| 2,364,649 | 12/1944 | Palliser | 66/117 |
| 2,404,855 | 7/1946 | Marshall | 66/117 |
| 2,462,473 | 2/1949 | Delaney | 66/117 |
| 2,633,720 | 4/1953 | Robbins | 66/117 |
| 3,438,223 | 4/1969 | Linstead | 66/1 A |

FOREIGN PATENT DOCUMENTS

| | | | |
|---|---|---|---|
| 534229 | 3/1941 | United Kingdom | 289/17 |
| 642594 | 9/1950 | United Kingdom | 66/1 A |

*Primary Examiner*—Mervin Stein
*Assistant Examiner*—Andrew M. Falik
*Attorney, Agent, or Firm*—Schapp and Hatch

[57] ABSTRACT

A device for facilitating knitting of cable stitch patterns having an elongated, bluntly pointed straight shank and a continuation of the shank formed in a loop of more than 360°, with a portion of the loop curving back into closely spaced proximity to the shank, the spacing being less than the thickness of the yarn being used. An end portion of the loop has a curvature exceeding the curvature of the adjacent portion of the loop so as to diverge from the latter.

A method is described for utilizing the cable stitch holder in which the pointed straight shank is inserted through a selected number of consecutive stitches on the knitting needle, in the same direction as the knitting needle, moving the cable stitch holder relative to the knitting needle to pull the selected number of stitches off the knitting needle, rotating the cable stitch holder around the axis of the straight shank to move the loop out of the way, knitting a second selected number of consecutive stitches from the knitting needle onto a second knitting needle, and thereafter knitting the stitches from the cable stitch holder onto the second knitting needle.

5 Claims, 3 Drawing Figures

CABLE STITCH HOLDER FOR KNITTING

BRIEF SUMMARY OF THE INVENTION

This invention relates to knitting devices, and more particularly to a cable stitch holder.

When knitting the pattern known as a "cable stitch", selected stitches must be removed from the knitting needle upon which the row of stitches is being formed. The desired number of stitches to accomplish the pattern are kept off of the knitting needle while a selected number of stitches are knit onto a second knitting needle, and the held stitches are then placed onto the second knitting needle.

Auxiliary devices have heretofore been proposed for holding or retaining the stitches removed from the first knitting needle while further stitches are being knit from the first needle onto the second knitting needle.

One such device is a conventional knitting needle having a "U" shaped bend in its medial portion. The bend is intended to retain the temporarily removed stitches, but is not effective for doing so, and the third needle gets in the way of the knitting operation. An example of such needle is found in U.S. Pat. No. 2,404,855 to G. R. Marshall.

A cable stitch holding device presently on the market somewhat resembles an enlarged safety pin. This device is of narrow "U" shape, with one end being bent laterally toward the opposite end and then back to form a hook in which the opposite end can be selectively retained. This device retains the removed stitches quite well, but is awkward to use in removing the stitches, and especially in returning the removed stitches to the knitting needles. An example of this type of device is found in U.S. Pat. No. 2,274,572 to H. A. Yates.

The cable stitch holder of the present invention overcomes the disadvantages of the described prior art and significantly facilitates and speeds up the knitting of cable stitch patterns. Accordingly, it is a principal object of the present invention to provide a cable stitch holder which will easily and quickly remove desired stitches from a knitting needle, and will securely hold said stitches until they are returned to a second knitting needle.

Another object of the present invention is to provide a cable stitch holder which can be employed to knit the removed stitches back onto the second needle.

Another object of the invention is to provide a cable stitch holder of the character described which may readily be moved out of the way of the conventional knitting needles, and then immediately brought into play when desired, without laying down the work or using two hands to remove the cable stitch holder.

Other objects and features of advantage will be apparent from the following specification, the drawings and the claims herein.

Figure 1:
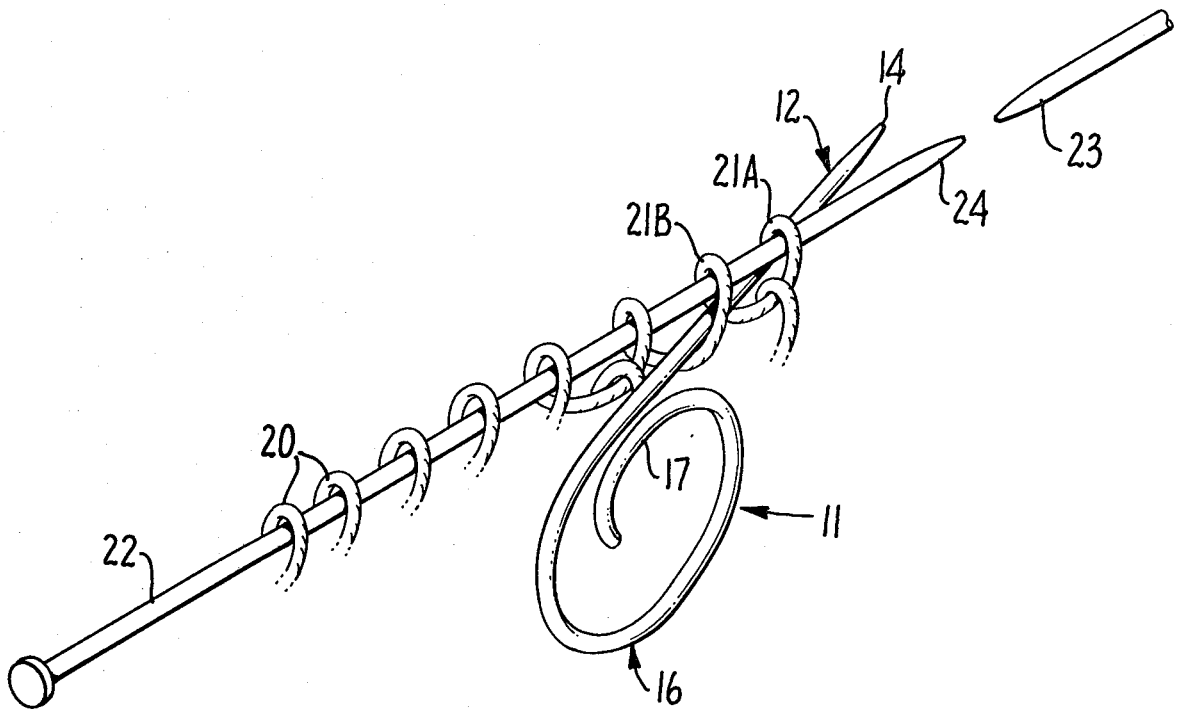
FIG. 1 is a perspective view of the cable stitch holder of the present invention shown in operative association with a knitting needle and yarn being knitted.
Figure 3:
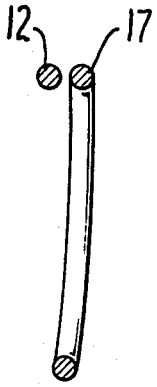
FIG. 3 is a vertical cross-sectional view taken substantially on the plane of line 3—3 of FIG. 2.
Figure 2:
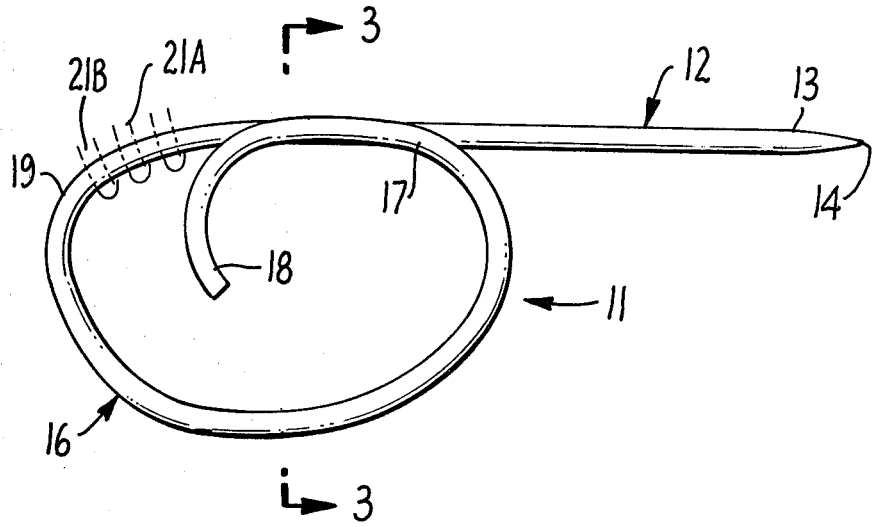
FIG. 2 is a side elevational view, on an enlarged scale, of the cable stitch holder of FIG. 1.

While only the preferred form of the invention is shown in the drawings, it will be apparent that changes and modifications could be made thereto within the ambit of the invention as defined in the claims.

DESCRIPTION OF THE PREFERRED EMBODIMENTS

Referring to the drawings in detail, it will be seen that the cable stitch holder 11 of the present invention includes an elongated straight shank 12 having an end 13 tapering to a blunt point 14. A continuation 16 of shank 12 is formed in a loop of more than 360°, with a portion 17 of the loop curving back into closely spaced proximity to the shank 12, and with an end portion 18 of the loop having a curvature exceeding the curvature of the adjacent portion 19 of the loop so as to diverge from the latter.

The cable stitch holder of the present invention is preferably made from lightweight material of the type used in the manufacture of knitting needles, for example, aluminum rod, aluminum tubing, plastic rod, plastic tubing, etc. In the preferred form shown, the shank 12 and loop 16 are circular in cross-section and have a uniform cross-sectional diameter. The end 13 is tapered and provided with a blunt point in a manner similar to a conventional knitting needle. Typically, the cross-sectional diameter of the shank 12 is ⅛ inch, the length is approximately 2¼ inches, the major dimenson of the loop 16 is about 1¾ inches, the minor dimension of the loop is approximately 1¼ inches, and the loop portion 17 of the loop is spaced approximately 1/16 of an inch from the adjacent portion of shank 12. This spacing should be substantially less than the gross diameter of the yarn being used, so that pushing of the stitches onto loop 16, past loop portion 17 will removably retain the stitches against accidentally sliding off of the cable stitch holder.

In FIG. 1 of the drawings, the cable stitch holder of the present invention is shown removing a desired number of stitches **21*a* and 21*b* from a row of stitches on a conventional knitting needle 22. The pointed end of the second conventional knitting needle 23 is also shown in FIG. 1. Preferably, and as here shown, the cross-sectional diameter of the cable stitch holder 11 is less than the cross-sectional diameter of knitting needles 22 and 23**.

DESCRIPTION OF THE METHOD

A row of stitches 20 is knit onto knitting needle 22 in the conventional manner. The shank 12 of the cable stitch holder 11 is inserted through a selected number of consecutive stitches on the knitting needle 22, with the pointed end 14 of shank 12 facing a direction similar to the direction faced by the pointed end 24 of knitting needle 22. As illustrated in FIG. 1 of the drawings, shank 12 has been inserted through two stitches, namely stitches **21*a* and 21*b***.

The cable stitch holder 11 is then moved relative to the knitting needle 22 to pull the selected stitches **21*a* and 21*b* off the pointed end 24 of the knitting needle 22. Once this has been accomplished, the cable stitch holder is easily rotated around the axis of its straight shank 12 to move the loop 16 out of the way of further knitting actions between needles 22 and 23. It should be noted that the cable stitch holder 11 is pushed far enough so that the stitches 21*a* and 21*b* pass the loop portion 17, so that stitches 21*a* and 21*b* will be held on loop 16** until it is desired to release them. Note also, that this action retains the cable stitch holder in place without any necessity for holding onto it.

A second selected number of consecutive stitches are knitted from the first knitting needle 22 onto the second knitting needle 23, and then the "held" stitches 21*a* and 21*b* are knitted directly from the cable stitch holder onto the second needle 23.

The foregoing steps are repeated for each line of stitches, with the cable stitch holder 11 being used alternately on needles 22 and 23. Note that the shape of the shank 12 and loop 16 facilitate this action of knitting back onto needle 23, and that no fasteners need be released, thus obviating any necessity for laying down the knitting or using both hands to remove the cable stitch holder.

From the foregoing, it will be seen that I have provided a novel cable stitch holder and method for using same which greatly facilitates the knitting of cable stitch patterns and increases both the efficiency and enjoyment of the user.

What is claimed is:

1. A cable stitch holder for knitting, comprising an elongated straight shank having an end tapering to a blunt point, a continuation of said shank formed in a loop of more than 360 degrees, a portion of said loop curving back into closely spaced proximity to said shank, and an end portion of said loop having a curvature exceeding the curvature of the adjacent portion of said loop so as to diverge from the latter, whereby stitches knitted onto said shank and forced past said loop portion are automatically held on said loop until pulled back onto said shank.

2. A cable stitch holder as described in claim 1 and wherein said closely spaced proximity of said portion to said shank is less than the thickness of yarn being knitted.

3. A cable stitch holder as described in claim 1 in combination with a straight knitting needle and wherein said shank is of smaller diameter than said knitting needle.

4. A method of knitting a cable stitch, comprising knitting a row of stitches onto a first knitting needle having a pointed end, inserting a pointed straight shank of a cable stitch holder having a loop of more than 360 degrees at its distal end through a selected number of consecutive stitches on said knitting needle with the pointed end of said straight shank facing a direction similar to the direction faced by the pointed end of said knitting needle, moving said cable stitch holder relative to said knitting needle to pull said selected number of stitches off the pointed end of said knitting needle, rotating said cable stitch holder around the axis of said straight shank to move said loops out of the way, knitting a second selected number of consecutive stitches from said first knitting needle onto a second knitting needle, and knitting said first selected number of stitches from said cable stitch holder onto said second needle.

5. The method as described in claim 4 and wherein said second needle is used to continue knitting and purling, and the steps of claim 4 are repeated with said cable stitch holder being inserted and moved to pull off the desired number of stitches from said second needle, knitting the desired number of stitches from said second knitting needle onto said first knitting needle, and knitting said stitches from said cable stitch holder onto said first needle.

* * * * *